United States Patent [19]

Abbate

[11] 4,143,494

[45] Mar. 13, 1979

[54] VAULT LINER REINFORCEMENT SYSTEM

[75] Inventor: Pio J. Abbate, Elmwood, Conn.

[73] Assignee: Doric Products, Inc., Massillon, Ohio

[21] Appl. No.: 885,005

[22] Filed: Mar. 9, 1978

[51] Int. Cl.[2] ..... E04H 13/00

[52] U.S. Cl. ..... 52/139; 52/124; 52/309.12

[58] Field of Search ..... 52/124, 128–142, 52/309.1, 309.2, 309.7, 309.9, 309.12

[56] References Cited

U.S. PATENT DOCUMENTS

| | | | |
|---|---|---|---|
| 1,932,792 | 10/1933 | Loresch | 52/141 X |
| 2,038,300 | 4/1936 | Kuettner | 52/138 |
| 2,099,648 | 11/1937 | Griffith | 52/139 X |
| 2,927,453 | 3/1960 | Patterson et al. | 52/141 X |
| 3,103,053 | 9/1963 | Hollis | 52/128 X |
| 3,208,188 | 9/1965 | Fulton et al. | 52/138 |
| 3,283,386 | 11/1966 | Cenegy | 52/140 X |
| 3,439,461 | 4/1969 | Chandler et al. | 52/139 |
| 3,464,171 | 9/1969 | Chandler et al. | 52/124 |

*Primary Examiner*—J. Karl Bell

*Attorney, Agent, or Firm*—Jenkins, Coffey & Hyland

[57] ABSTRACT

A system of reinforcing gussets or strips is provided for strengthening a burial vault liner against flexure under the load presented by flowable cementitious vault forming material. The reinforcing gusset system prevents the parts of the vault liner, the vault liner lid and body, from flexure such as would degrade the seal between the vault body and vault lid.

15 Claims, 5 Drawing Figures

VAULT LINER REINFORCEMENT SYSTEM

This invention relates to underground vaults, and particularly to an improved vault liner structure which cooperates with other form elements to provide a molding cavity for flowable cementitious material, which then sets in the forms to provide a vault.

Several types of vault construction systems are known. There are, for example, the systems of the following United States patents: U.S. Pat. No. 1,839,149; U.S. Pat. No. 2,927,453; U.S. Pat. No. 3,130,520; U.S. Pat. No. 3,439,461; and U.S. Pat. No. 3,464,171. These systems produce vaults of various types, including combination asphalt and concrete vaults, metal-lined concrete vaults, synthetic resin-lined concrete vaults, and combinations of the above with reinforcing materials, e.g., steel reinforcing rods or wires, for the concrete.

A significant problem associated with many types of concrete vault structures is that the liners must be kept from flexing under the load of the plastic, flowable cement and concrete mixtures which are poured onto the liners during vault construction. If the liner of a vault is permitted to flex, the inside dimensions and configuration of the vault will not be those of the unflexed liner. This can cause significant difficulties, particularly if the liner is permitted to flex in one or more of those areas about the peripheries of the two liner components, the body and lid of the liner, where a seal is formed between the body and liner to seal the vault. Flexure of the liner under the load of concrete in these regions may prevent an otherwise good vault from being able ever to be sealed.

It is an object of the present invention to provide an improved vault liner structure sufficiently reinforced to minimize detrimental flexure of the liner materials.

According to the present invention, a liner of a vault casting form includes a lid liner and a body liner both constructed from a material which is subject to some flexure under the load of a flowable cementitious material. The lid liner includes perimetrally extending sealing surfaces defining cooperatively with corresponding perimetral surfaces of the vault body liner a vault seal. The lid liner also includes a corresponding perimetrally extending structure on the top side of the lid liner which provides the perimetrally extending sealing surfaces. Means are provided for reinforcing the top side structure to prevent excessive detrimental flexure of the lid liner under load, thereby preventing the degrading of the vault sealing surfaces. The body liner includes corresponding perimetrally extending structure which provides its perimetral sealing surfaces. Means are provided to reinforce the body liner structure which provides its perimetral sealing surfaces to prevent excessive body liner flexure in the sealing surface area. The reinforcing means includes strips extending transversely across the perimetrally extending top side structure of the lid liner and corresponding structure of the body liner. The strips on the lid liner are fixed at their ends to a portion of the lid liner inside the perimetrally extending top side structure and to a portion of the lid liner outside the perimetrally extending top side structure. The strips on the body liner are fixed at one end to a portion of the body liner perimetrally outside the sealing surface providing structure and to a portion of the body liner inside such structure.

Typically, the lid liner top side structure will include an upwardly opening perimetrally extending groove separating a central portion of the lid liner from a perimetral portion of the lid liner. The reinforcing strips extend across the groove from the perimetral portion to the central portion and are fixed at their opposite ends to these portions, respectively. Illustratively, the ends of the reinforcing strips will be attached to the lid liner adjacent the perimetrally extending edges of the groove. Alternatively, one end of each strip can be attached adjacent the perimetrally extending edge of the groove at the perimetral portion, and the other end of the reinforcing strip can be affixed to the central portion of the lid liner at some distance from the other perimetrally extending edge of the groove. Under certain conditions, such as in nesting of the reinforced lid liners for storage, this latter reinforcement system may be more desirable to provide more clearance between adjacent nested lid liners in a vertical stack of lid liners.

Importantly, the reinforcing strips define, with the groove, pockets into which the cementitious material flows and within which the material later sets to capture the lid liner on the set cement and to reinforce the set cement. Toward this latter end, it may be desirable to provide stiffening and reinforcing rods which extend longitudinally along the central portion of the top side of the lid liner adjacent the line along which the reinforcing strips are attached to the central portion. Use of such additional reinforcing rods also helps to minimize flexure of the lid liner after flowable cementitious material is applied to it. The stiffening rods may be glued or otherwise attached to the lid liner after the lid liner is formed.

Illustratively, the lid liner is constructed from a fiberglass reinforced catalyzed resin sprayed-up or layed-up on a form. Other known prior art liner materials can also be used.

The invention may best be understood by referring to the following description and accompanying drawings which illustrate the invention. In the drawings.

Figure 1:
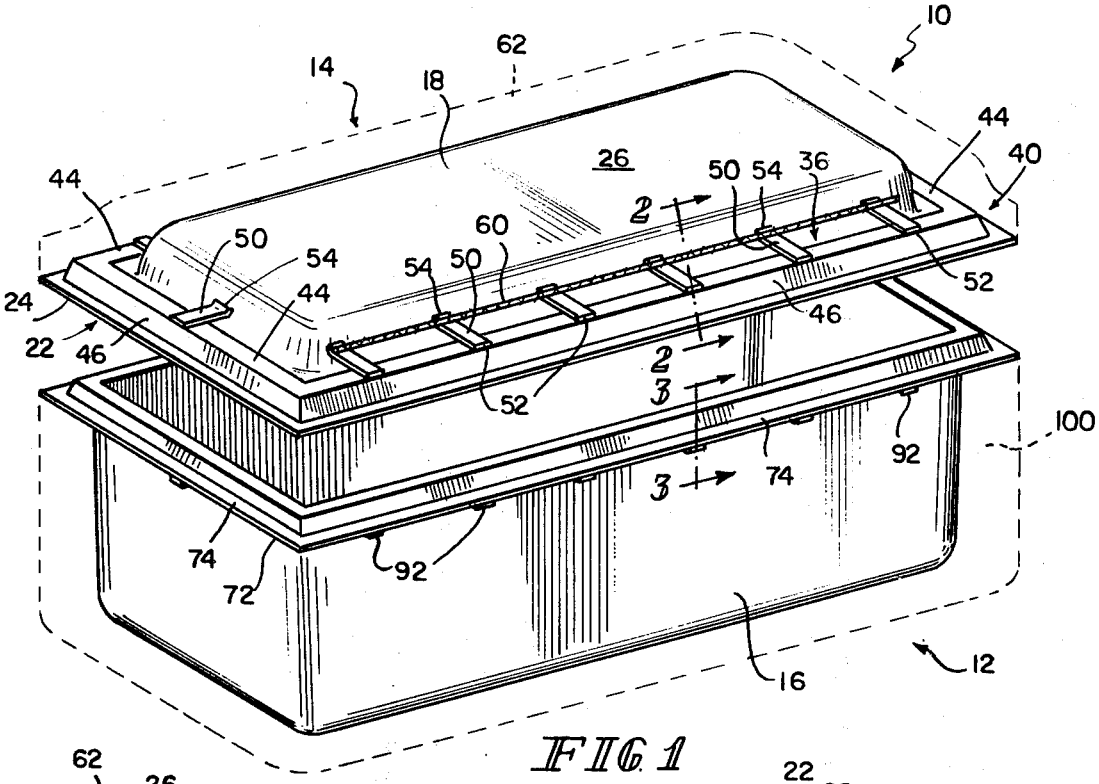
FIG. 1 is a perspective view of a typical vault liner consisting of a liner lid and liner body, the broken lines representing the locations of set concrete in the finished vault.

Referring now to FIG. 1, a burial vault 10 includes a vault body 12 and a lid 14. The vault components 12, 14 are formed from flowable cementitious material, illustratively, a concrete mix, which is poured into forms and permitted to set to concrete. The concrete of the vault components 10, 12, is illustrated in FIG. 1 in broken lines. The innner portion of the form within which each of body 12 and lid 14 is formed is generally referred to as a liner. In this embodiment, the body liner is indicated at 16 and the lid liner is indicated at 18. The body liner 16 and lid liner 18 upon which the cementitious material is poured, and about which the material sets to concrete, form integral parts of the finished vault. Typically, the body liner 16 and lid liner 18 will be constructed on molds or jigs from any of a number of resinous material, with or without fiber reinforcement.

Figure 2:
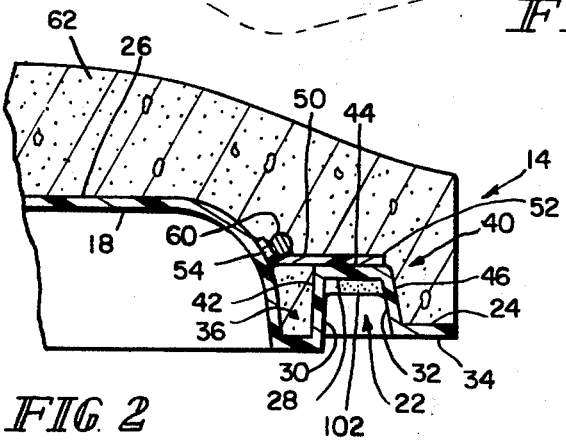
FIG. 2 is a fragmentary sectional view of a finished vault lid taken generally along section lines 2—2 of FIG. 1.
Figure 4:
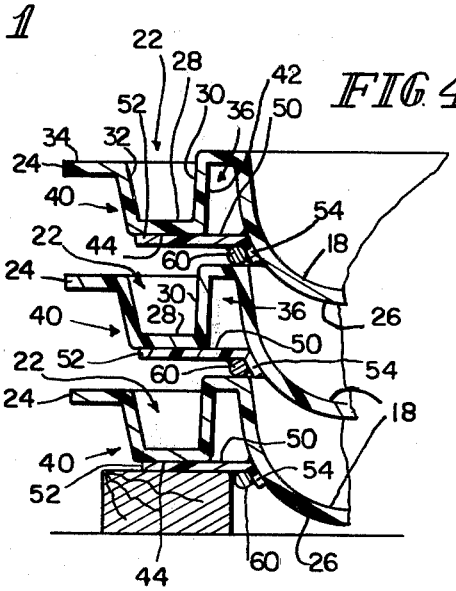
FIG. 4 is a fragmentary sectional elevational view of a nested upside down vertical stack of lid liners in storage.
Figure 5:
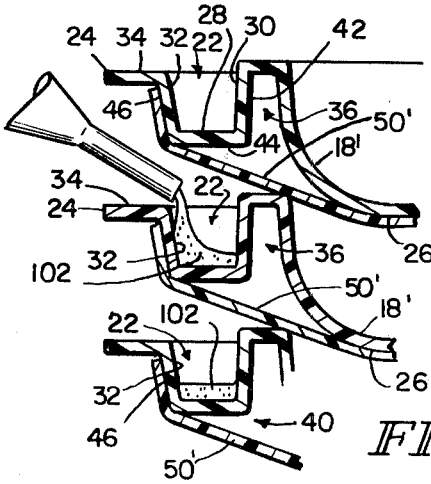
FIG. 5 is a fragmentary sectional elevational view of another nested upside down vertical stack of lid liners constructed according to the present invention, but with reinforcing members different from those illustrated in FIGS. 1-4.

As best illustrated in FIGS. 2, 4 and 5, each lid liner 18 includes a perimetral groove 22 separating a perimetrally extending flange portion 24 from a central, upwardly, convex top portion 26. The perimetral groove 22 provides a downwardly facing permietrally extending surface 28 and adjacent surfaces 30, 32. Perimetrally extending flange portion 24 provides a downwardly facing sealing surface 34. These surfaces cooperate with corresponding surfaces on the body liner 16 when the vault 10 is sealed. Lid liner 18 also includes an upwardly opening groove or channel 36 which cooperates with the body liner 16 when vault 10 is sealed, in a manner to be described. Downwardly opening channel 22 is provided on the under side of a vertically upwardly extending ridge 40 which extends about the perimeter of lid liner 18. Ridge 40 is formed by surface 42 of groove 36, upwardly facing surface 44, and perimetrally facing surface 46 adjacent the flange 24.

When a vault lid 14 is formed by pouring flowable cementitious material on top of the lid liner 18, the lid liner 18 can flex under the weight of the cementitious material. Such flexure of the lid liner 18 can affect deleteriously the configurations and relative orientations of surfaces 28, 30, 32 and 34 thereby adversely affecting the ability of the lid liner 18 to seal to the body liner 16 when the vault 10 is closed. Such flexure of the lid liner 18 therefore must be avoided, or at least minimized. To this end, a plurality of strips or gussets 50 of reinforcing material (FIGS. 1, 2 and 4) are attached to the upper side of the lid liner 18 to extend between surface 44 and the upper surface of the upwardly convex portion 26, about the perimeter of the lid liner 18. Each of the reinforcing strips 50 may be constructed from the same material as the lid liner 18 and body liner 16, and may be attached by any suitable means. The outer end 52 of each gusset 50 extends across the surface 44, terminating at its perimetrally outer extent adjacent surface 46. The inner end 54 of each gusset 50 illustrated in FIGS. 1, 2 and 4 is attached to the outside surface of the central upwardly convex portion 26.

In the embodiment of FIG. 5, an alternative gusset construction and attachment scheme are illustrated. In the embodiment illustrated there, the lid liners 18', which are vertically stacked in upside down, nested orientation for storage include gussets 50' which are attached to surface 46 of the lid liner 18 and extend upwardly across surface 44 and groove 36 to be attached to the genrally flat top surface of upwardly convex portion 26.

To add further stiffness and rigidity to the lid liner 18, a reinforcing rod 60 extends longitudinally along each side of the lid liner 18 on the central upwardly convex portion 26 adjacent the inner ends 54 of the gussets 50. The illustrated arrangement places the reinforcing rods 60 over the inner ends 54 of gussets 50. Other arrangements are, of course, possible.

The above-disclosed reinforcing structure aids the lid liner 18 to retain its original shape when flowable cementitious material is poured on it and until the flowable material sets to form the outer concrete portion 62 of the vault lid 14 (FIGS. 1 and 2). An additional benefit derived from the use of reinforcing gussets 50 of the type illustrated in FIGS. 1, 2 and 4, is that the flowable cementitious material flows into the groove 36 beneath each of gussets 50 to secure the lid liner 18 and outer concrete portion 62 of lid 14 in a unitary construction.

Figure 3:
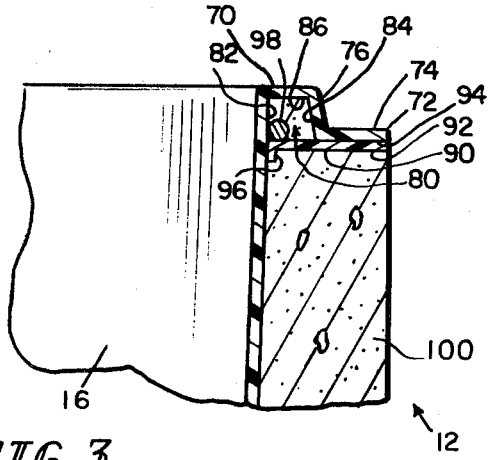
FIG. 3 is a fragmentary sectional view of a finished vault body taken generally along section lines 3—3 of FIG. 1.

The same structure is applied in the instant arrangement to the body liner 16 of the vault. Referring now to FIGS. 1 and 3, and particularly to FIG. 3, the body liner 16 includes a peripherally extending, upwardly facing sealing surface 70 and a peripherally extending flange 72 providing an upwardly facing sealing surface 74 joined by a peripherally facing sealing surface 76. Surfaces 70, 76 are provided on the upper side of a downwardly opening channel or groove 80 having side walls 82, 84 joined by an upper wall 86. Reinforcing strips or gussets 90 include first ends 92 attached to the underside 94 of flange 72 and second ends 96 attached to side wall 82. Reinforcing and longitudinal stiffening rods 98 can be added to the body liner 16 as illustrated. When the cementitious material is poured into a form, the inner side of which is provided by body liner 16, the sealing surfaces 70, 74, 76 are protected against deformation under the weight of the flowable material by gussets 90 and reinforcing rods 98. When the vault body 12 is removed from the form, the body liner 16 adheres to the set outer concrete portion 100 of the vault body 12, due, at least in part, to the concrete in downwardly opening groove 80 above the gussets 90.

A preferred technique for attaching the gussets to the body liner 16 and lid liner 18 is to attach the gussets to the hardened liners with a suitable adhesive. Resin coated cardboard provides a satisfactory gusset.

Referring again to FIGS. 4–5, the gussets and reinforcing rods are useful to permit storage of body liners 16 and lid liners 18 in upside-down nested fashion. The gussets and rods support adjacent body liners 16 and lid liners 18 while maintaining sufficient separation between them to keep them from becoming stuck together. This feature is particularly advantageous with lid liners 18, since the separation between perimetral grooves 22 of adjacent lid liners 18 permits a layer 102 (FIGS. 2 and 5) of sealant material, such as polypropylene, to be deposited on the sealing surfaces 28 of the downwardly opening grooves or channels 22 of the nested upside down lid liners 18. The application of the sealant material in the factory where the liners are made is very advantageous. The sealant can be efficiently applied in quantities sufficient to permit volume application. When liners are made by individual small vault casters, the small volume application of sealant is very inefficient.

What is claimed is:

1. A vault lid liner constructed from a material subject to flexure under the load of a flowable cementitious material, the lid liner having an upwardly opening perimetrally extending groove separating a central portion of the lid liner from a perimetral portion of the lid liner, and a plurality of means for reinforcing the lid liner, the reinforcement means extending across the groove.

2. The apparatus of claim 1 wherein the reinforcing means comprises elongated reinforcing strips or gussets, one end of each gusset being fixed adjacent one perimetrally extending edge of the groove.

3. The apparatus of claim 2 wherein the other end of each reinforcing gusset is fixed adjacent the other perimetrally extending edge of the groove.

4. The apparatus of claim 2 wherein the other end of each reinforcing gusset is fixed to the central portion of the lid liner adjacent the other perimetrally extending edge of the groove.

5. The apparatus of claim 2 wherein the reinforcing gussets define with the groove pockets into which the cementitious material flows and within which the cementitious material later sets to capture the lid liner on the set cementitious material.

6. The apparatus of claim 5 and further comprising reinforcing rods extending parallel to the groove adjacent at least two edges of the lid liner and located where the reinforcing gussets are joined to the lid liner.

7. The apparatus of claim 6 wherein the reinforcing rods are attached to the lid liner adjacent the inner peripheral edges of the groove.

8. A vault lid liner constructed from a material subject to flexure under the load of a flowable cementitious material, the lid liner having a perimetrally extending surface on the underside thereof defining cooperatively with a vault body liner a perimetrally extending seal, a corresponding perimetrally extending structure on the upper side of the lid liner to provide the downwardly facing perimetrally extending surface, and means for reinforcing the upper side structure to prevent excessive detrimental flexure of the lid liner under load from degrading the vault seal, the reinforcing means including gussets or strips extending transversely across the perimetrally extending top side structure and fixed at their ends adjacent the perimeter of the lid liner and to a portion of the lid liner inside the perimetrally extending top side structure.

9. A vault body liner constructed from a material subject to flexure under the load of flowable cementitious material, the body liner having a downwardly opening perimetrally extending groove separating a central portion of the body liner from a perimetral portion, and a plurality of means for reinforcing the body liner, the reinforcement means extending across the groove.

10. The apparatus of claim 9 wherein the reinforcing means comprises elongated reinforcing strips or gussets, one end of each gusset being fixed adjacent one perimetrally extending edge of the groove.

11. The apparatus of claim 10 wherein the reinforcing gussets cooperate with the groove to define pockets into which the cementitious material flows and within which the cementitious material later sets to capture the body liner on the set cementitious material.

12. The apparatus of claim 11 and further comprising reinforcing rods extending parallel to the groove adjacent at least two edges of the body liner and located where the reinforcing gussets are joined to the body liner.

13. A vault body liner constructed from a material subject to flexure under the load of flowable cementitious material, the body liner having a perimetrally extending upwardly facing surface defining cooperatively with a vault lid liner a perimetrally extending vault seal, a corresponding perimetrally extending structure on the under side of the body liner providing the upwardly facing surface, and means for reinforcing the underside structure, the reinforcing means including reinforcing gussets extending transversely across the perimetrally extending underside structure and fixed at their ends to a portion of the body liner inside the perimetrally extending underside structure and to a portion of the body liner outside the perimetrally extending underside structure.

14. A vault liner including a body part and a lid part, at least one of the parts being constructed from a material subject to flexure under the load of a flowable cementitious material, the part including a structure provoiding a perimetrally extending surface cooperating with a surface of the other part to define a vault seal, the sealing surface providing structure extending about the flexible part adjacent the perimeter thereof, and a plurality of means for reinforcing the flexible part to prevent excessive flexure of the sealing surface providing structure and resulting detriment to the seal, the reinforcing means extending across the sealing surface providing structure.

15. The apparatus of claim 14 wherein the sealing surface providing structure includes a groove formed in the side of the part opposite the side on which the sealing surface is located, the groove extending perimetrally about the flexible part, and the reinforcing means comprises a plurality of strips or gussets which extend across the groove, one end of each gusset being attached to the flexible part on one side of the groove and the other end of each gusset being attached to the flexible part on the other side of the groove.

* * * * *

UNITED STATES PATENT OFFICE

CERTIFICATE OF CORRECTION

Patent No. 4,143,494 Dated March 13, 1979

Inventor(s) Pio J. Abbate

It is certified that error appears in the above-identified patent and that said Letters Patent are hereby corrected as shown below:

Column 5, line 12, (claim 7), change "peripheral" to --perimetral--.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*